US011206960B2

(12) United States Patent
McRorie et al.

(10) Patent No.: US 11,206,960 B2
(45) Date of Patent: Dec. 28, 2021

(54) SURFACE CLEANING APPARATUS

(71) Applicant: TTI (MACAO COMMERCIAL OFFSHORE) LIMITED, Macau (MO)

(72) Inventors: Robert McRorie, Huntersville, NC (US); Douglas Rukavina, Concord, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 395 days.

(21) Appl. No.: 16/184,650

(22) Filed: Nov. 8, 2018

(65) Prior Publication Data

US 2019/0142232 A1 May 16, 2019

Related U.S. Application Data

(60) Provisional application No. 62/585,108, filed on Nov. 13, 2017.

(51) Int. Cl.

| | |
|---|---|
| ***A47L 5/30*** | (2006.01) |
| ***A47L 9/10*** | (2006.01) |
| ***A47L 9/04*** | (2006.01) |
| ***A47L 11/40*** | (2006.01) |
| ***A46B 13/00*** | (2006.01) |

(Continued)

(52) U.S. Cl.

CPC ..... *A47L 5/30* (2013.01); *A46B 7/10* (2013.01); *A46B 13/001* (2013.01); *A46B 13/003* (2013.01); *A47L 9/0477* (2013.01); *A47L 9/102* (2013.01); *A47L 11/34* (2013.01); *A47L 11/4041* (2013.01)

(58) Field of Classification Search

CPC ..... A47L 5/30; A47L 9/0477; A47L 9/102; A47L 9/1134; A47L 11/4041; A46B 7/10; A46B 13/001; A46B 13/003

See application file for complete search history.

(56) References Cited

U.S. PATENT DOCUMENTS

| | | | | |
|---|---|---|---|---|
| 4,498,214 A | | 2/1985 | Oxel | |
| 4,646,380 A | * | 3/1987 | Kobayashi | A47L 11/33 15/179 |
| 5,029,361 A | | 7/1991 | Murata et al. | |

(Continued)

FOREIGN PATENT DOCUMENTS

| | | |
|---|---|---|
| CN | 102755138 A | 10/2012 |
| CN | 206621324 U | 11/2017 |

(Continued)

OTHER PUBLICATIONS

International Search Report and Written Opinion for Application No. PCT/US2018/059854, dated Apr. 15, 2019, 14 pages.

(Continued)

*Primary Examiner* — Dung Van Nguyen

(74) *Attorney, Agent, or Firm* — Michael Best & Friedrich LLP

(57) ABSTRACT

A surface cleaning apparatus comprises a brushroll that rotates about an axis. The brushroll defines a cylindrical portion and the axis extends centrally through the cylindrical portion. The brushroll also includes a rib that extends in a direction away from the axis. The rib includes a face extending along a line that is collinear with a secant through the cylindrical portion. A brush member extends from the face.

21 Claims, 11 Drawing Sheets

(51) Int. Cl.
*A46B 7/10* (2006.01)
*A47L 11/34* (2006.01)

(56) References Cited

U.S. PATENT DOCUMENTS

| | | | | |
|---|---|---|---|---|
| 5,056,181 | A | 10/1991 | Tsuchiya et al. | |
| 6,532,619 | B2 | 3/2003 | Kasper et al. | |
| 7,140,062 | B1 * | 11/2006 | Chen | A46B 13/006 15/182 |
| 9,693,663 | B2 | 7/2017 | Kasper | |
| 9,756,997 | B2 | 9/2017 | Maoro et al. | |
| 10,034,588 | B2 | 7/2018 | Kasper et al. | |
| 2014/0259522 | A1 * | 9/2014 | Kasper | A47L 5/26 15/383 |
| 2015/0272414 | A1 | 10/2015 | Janzen et al. | |
| 2016/0166052 | A1 | 6/2016 | Kasper et al. | |

FOREIGN PATENT DOCUMENTS

| | | | |
|---|---|---|---|
| DE | 102014102812 | A1 | 9/2015 |
| EP | 0803223 | A2 | 10/1997 |
| GB | 2518882 | A1 | 4/2015 |
| JP | H01262825 | A | 10/1989 |
| JP | H01314523 | A | 12/1989 |
| KR | 20040060771 | A | 7/2004 |
| KR | 101455064 | B1 | 11/2014 |
| WO | 2018059713 | A1 | 4/2018 |

OTHER PUBLICATIONS

Chinese Patent Office Action for Application No. 201880073171.3 dated Apr. 6, 2021 (13 pages including statement of relevance).

* cited by examiner

SURFACE CLEANING APPARATUS

CROSS-REFERENCE TO RELATED APPLICATIONS

This application claims priority to U.S. Provisional Patent Application No. 62/585,108 filed on Nov. 13, 2017, the entire content of which is incorporated herein by reference.

BACKGROUND

The present invention relates to surface cleaning apparatus, and more particularly to brushrolls for surface cleaning apparatus. Surface cleaning apparatus use brushrolls to agitate a surface to be cleaned. In some surface cleaning apparatus, such as floor and carpet cleaners, the brushroll is located near the suction inlet. The brushroll agitates debris that is attached to or embedded in the surface being cleaned, which allows the suction source to draw the debris through the suction inlet.

SUMMARY

In one embodiment, a surface cleaning apparatus includes a brushroll that rotates about an axis. The brushroll defines a cylindrical portion and the axis extending centrally through the cylindrical portion. The brushroll further includes a rib that extends in a direction away from the axis. The rib includes a face extending along a line that is collinear with a secant through the cylindrical portion and a brush member extends from the face.

In another embodiment, a surface cleaning apparatus includes a brushroll that rotates about an axis. The brushroll includes a body, a rib extending outwardly from the body, and the rib having a face that forms an angle in the range of 60-120 degrees with respect to the body. The brushroll further includes a brush member extending outwardly the face and the brush member forms an angle in the range of 70-110 degrees with respect to the face.

In another embodiment, a surface cleaning apparatus includes a brushroll including a body having a cylindrical portion, a plurality of ribs extending outwardly from the cylindrical portion, and each rib having a face that contacts the cylindrical portion at a contact edge. The brushroll further includes a plurality of bristles extending from each face, at least a portion of each bristle being parallel, plus or minus 20 degrees, to at least one tangent to the cylindrical portion at the contact edge.

In another embodiment, a surface cleaning apparatus includes a brushroll that rotates about an axis. The brushroll includes a body and a plurality of ribs that extend outwardly from the body and helically along and around the axis. The brushroll further includes a plurality of bristles extend from a trailing face of each of the plurality of ribs.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
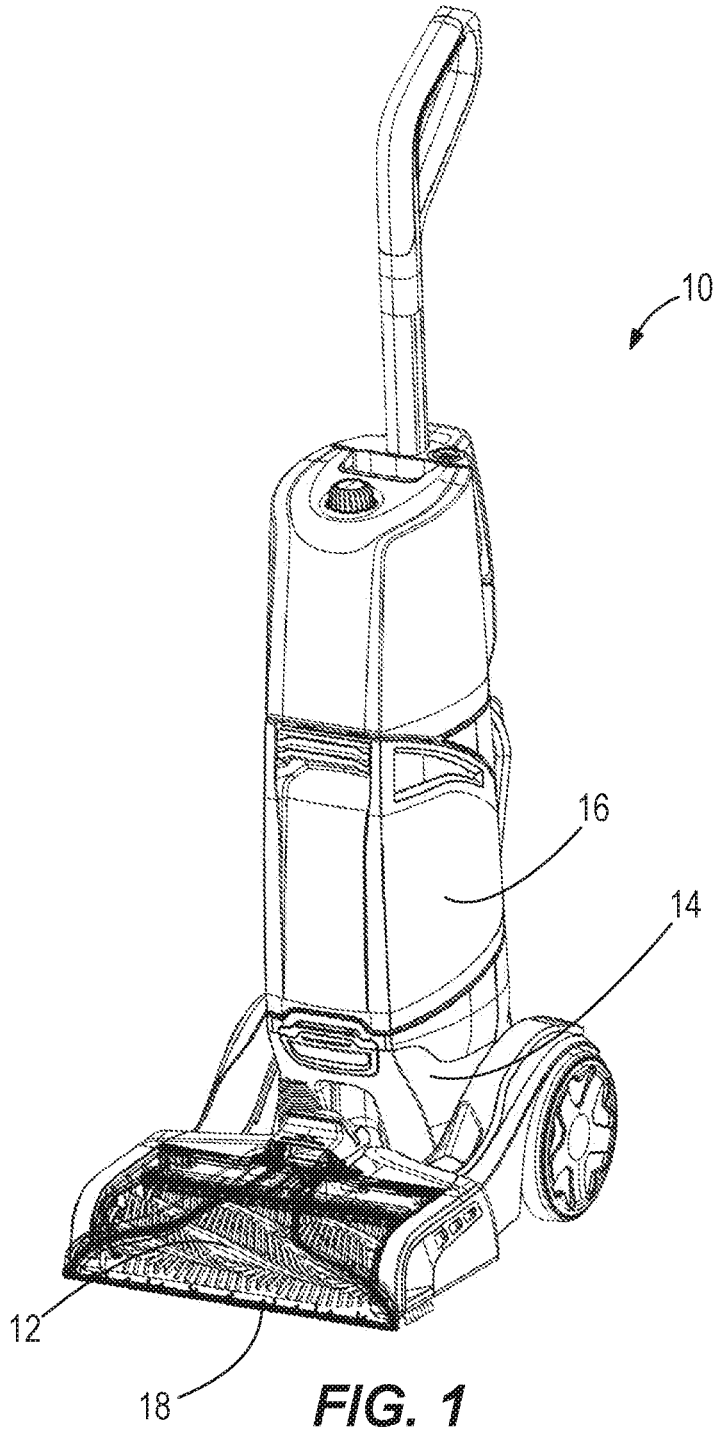
FIG. 1 is a perspective view of a surface cleaning apparatus.
Figure 2:
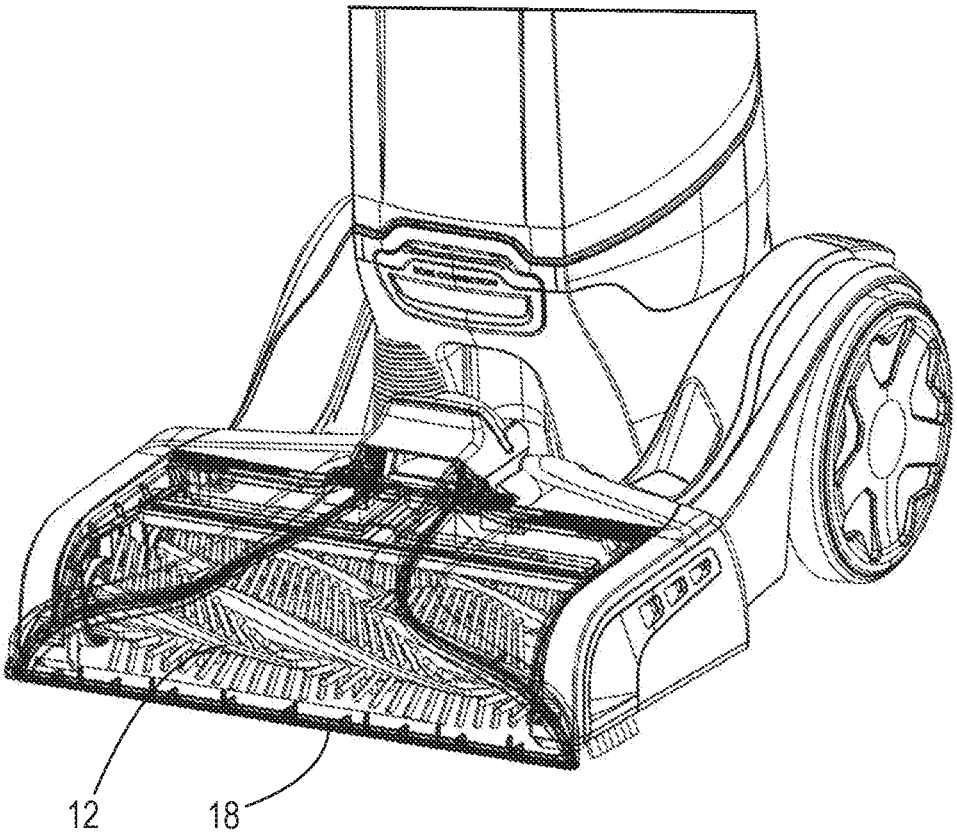
FIG. 2 is an enlarged perspective view of the surface cleaning apparatus of FIG. 1.

A surface cleaning apparatus 10 shown in FIGS. 1 and 2 includes a brushroll 12 operable to act on a surface to be cleaned. Although the illustrated surface cleaning apparatus 10 is a carpet extractor, in other embodiments the surface cleaning apparatus could include any type of surface cleaning apparatus that uses a brushroll. For example, an upright-style vacuum cleaner, a canister style-vacuum cleaner, a power sweeper, a hard floor cleaner and the like. The surface cleaning apparatus 10 includes a suction source 14, a dirt separator 16 (a wet recovery tank in the illustrated embodiment), and a suction nozzle 18. The suction source 14 draws debris through the suction nozzle 18 and the debris is stored in the separator 16.

Figure 3:
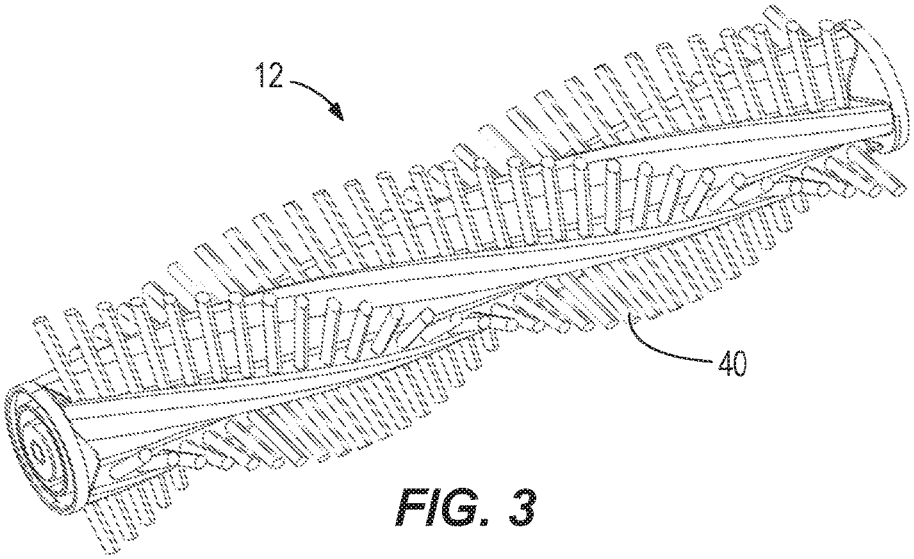
FIG. 3 is a perspective view of a brushroll of the surface cleaning apparatus of FIG. 1.
Figure 4:
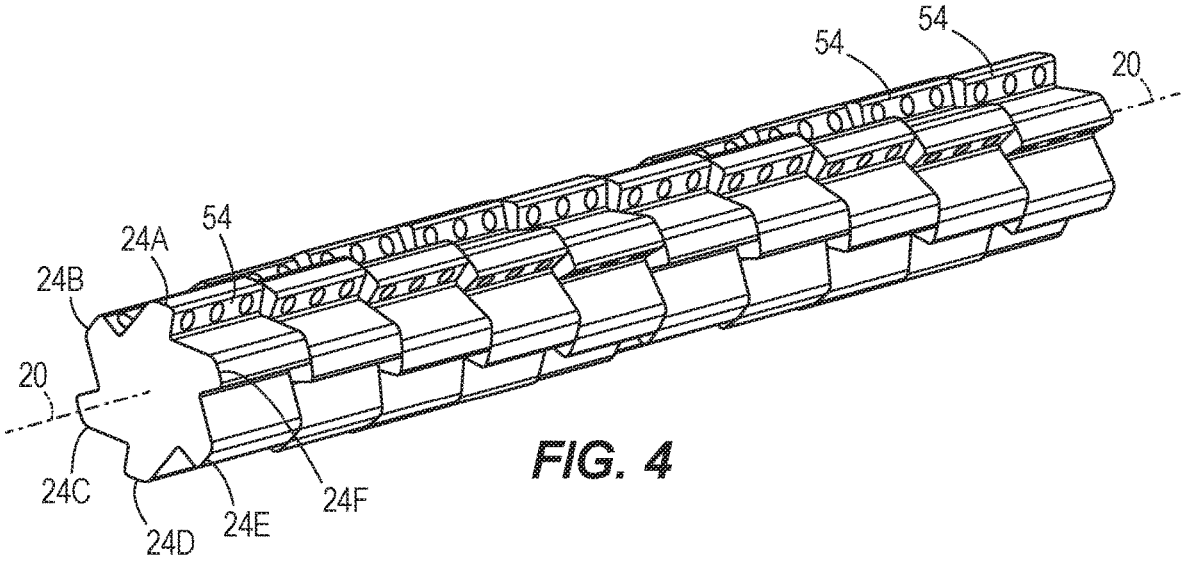
FIG. 4 is a perspective view of a brushroll of the surface cleaning apparatus of FIG. 1 with a plurality of brush members removed.
Figure 5:
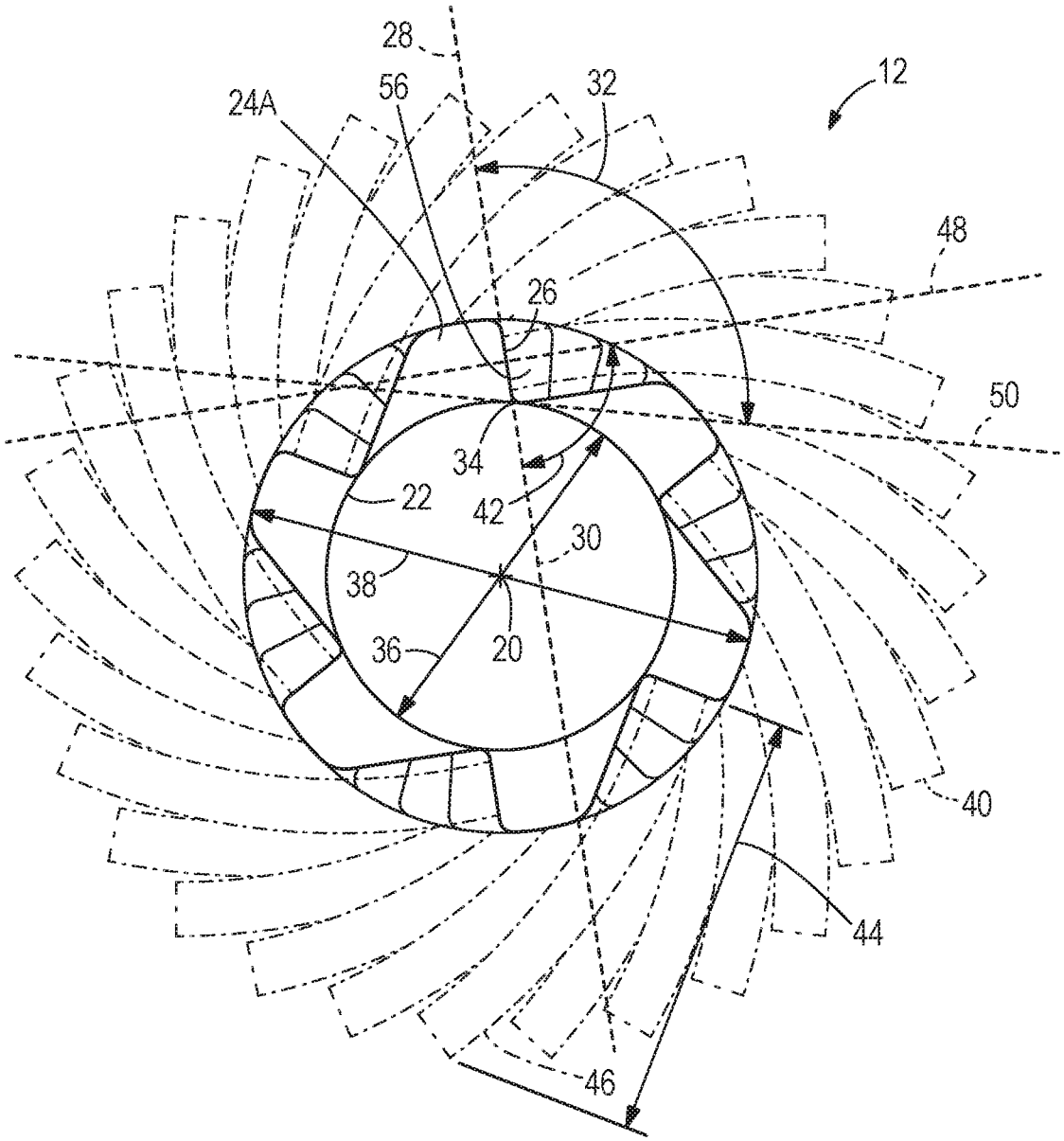
FIG. 5 is a side view of a brushroll of the surface cleaning apparatus of FIG. 1.
Figure 7:
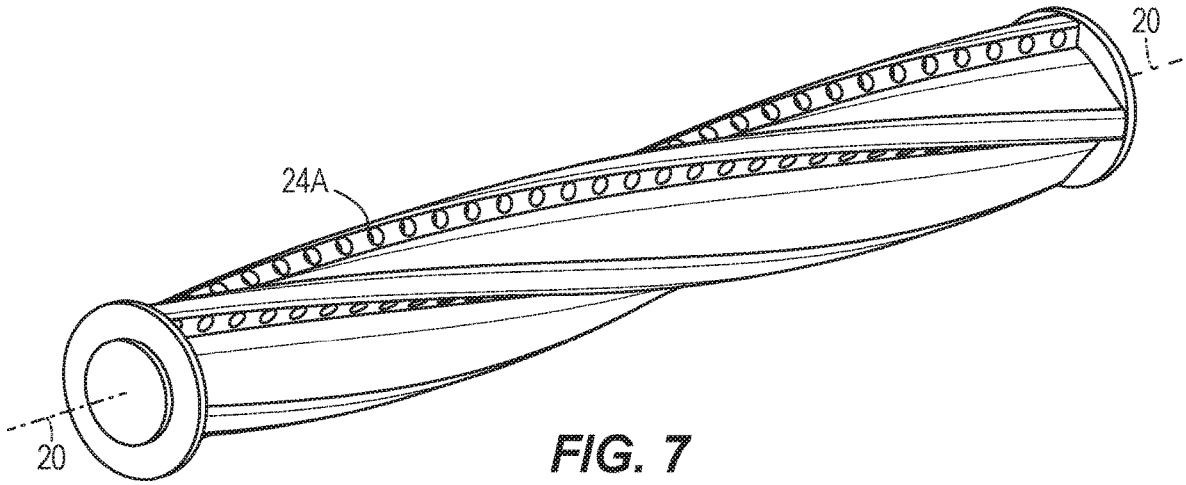
FIG. 7 is a perspective view the brushroll of FIG. 6 with a plurality of bristle elements removed.

Referring to FIGS. 3-5, the brushroll 12 includes a brushroll body and one or more brush members 40. The brushroll 12 rotates about an axis 20 in operation. As illustrated in FIG. 5, a schematic cylindrical portion 22 having a cylindrical portion diameter 36 extends around the axis 20. The schematic cylindrical portion 22 may have a circular cross section or may be any other shape desired for the brushroll. The axis 20 extends centrally through the cylindrical portion 22. The brushroll 12 further includes ribs 24A-24F extending from the cylindrical portion 22 in a direction away from the axis 20. An outer extent of the ribs form a brushroll body outer diameter 38. The brushroll embodiment illustrated in FIG. 4 includes six ribs, 24A-24F, whereas the brushroll embodiment illustrated in FIG. 7 includes four ribs. However, in other embodiments, the brushroll may include one, two, three, or more ribs. As the brushroll 12 rotates about the axis 20 in operation, each of the ribs 24A-24F have a trailing portion from which the brush members 40 extend, and a leading portion opposite the trailing portion.

The ribs 24A-24F are generally the same and therefore only one of the ribs 24A will be explained in detail. The rib 24A extends in a direction away from the axis 20 and the cylindrical portion 22 to the brushroll body outer diameter 38 forming a rib height. In one embodiment, the cylindrical portion diameter 36 is between about 45% and 80% of the brushroll body outer diameter 38. In another embodiment, the cylindrical portion diameter 36 is between about 60% and 75% of the brushroll body outer diameter 38. Referring to FIG. 5, the rib 24A includes a rib face 26 on the trailing portion of the rib 24A extending along a line 28 that is collinear with a secant 30 through the cylindrical portion 22. Stated another way, a secant 30 of a cross-section through the cylindrical portion 22 aligns with the rib face 26 of the trailing portion of the rib 24A. In the illustrated embodiment, the secant 30 is offset from the axis 20. The rib face 26 intersects the cylindrical portion 22 at a contact edge 34. The rib face 26 is also at an angle 32 with respect to the cylindrical portion 22. Specifically, the angle 32 is measured between the rib face 26 and a tangent 50 of the cylindrical portion 22 at the contact edge 34. In one embodiment the angle 32 is in a range from 60 degrees to 120 degrees. In another embodiment, the angle 32 is in a range from 80 degrees to 100 degrees. In the illustrated embodiment, the rib 24A extends helically along and around the axis 20.

Figure 8:
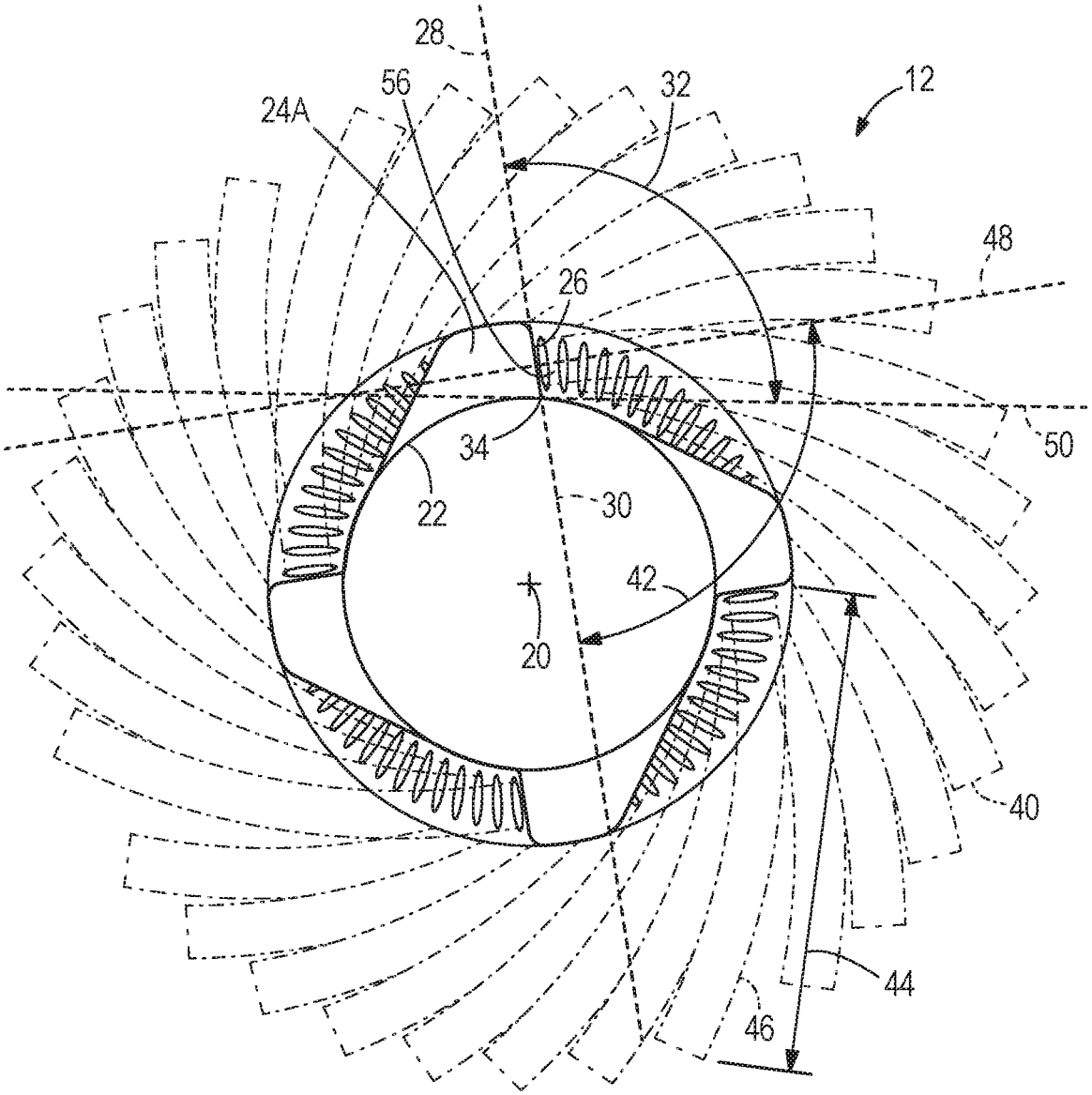
FIG. 8 is a side view of the brushroll of FIG. 6.
Figure 9:
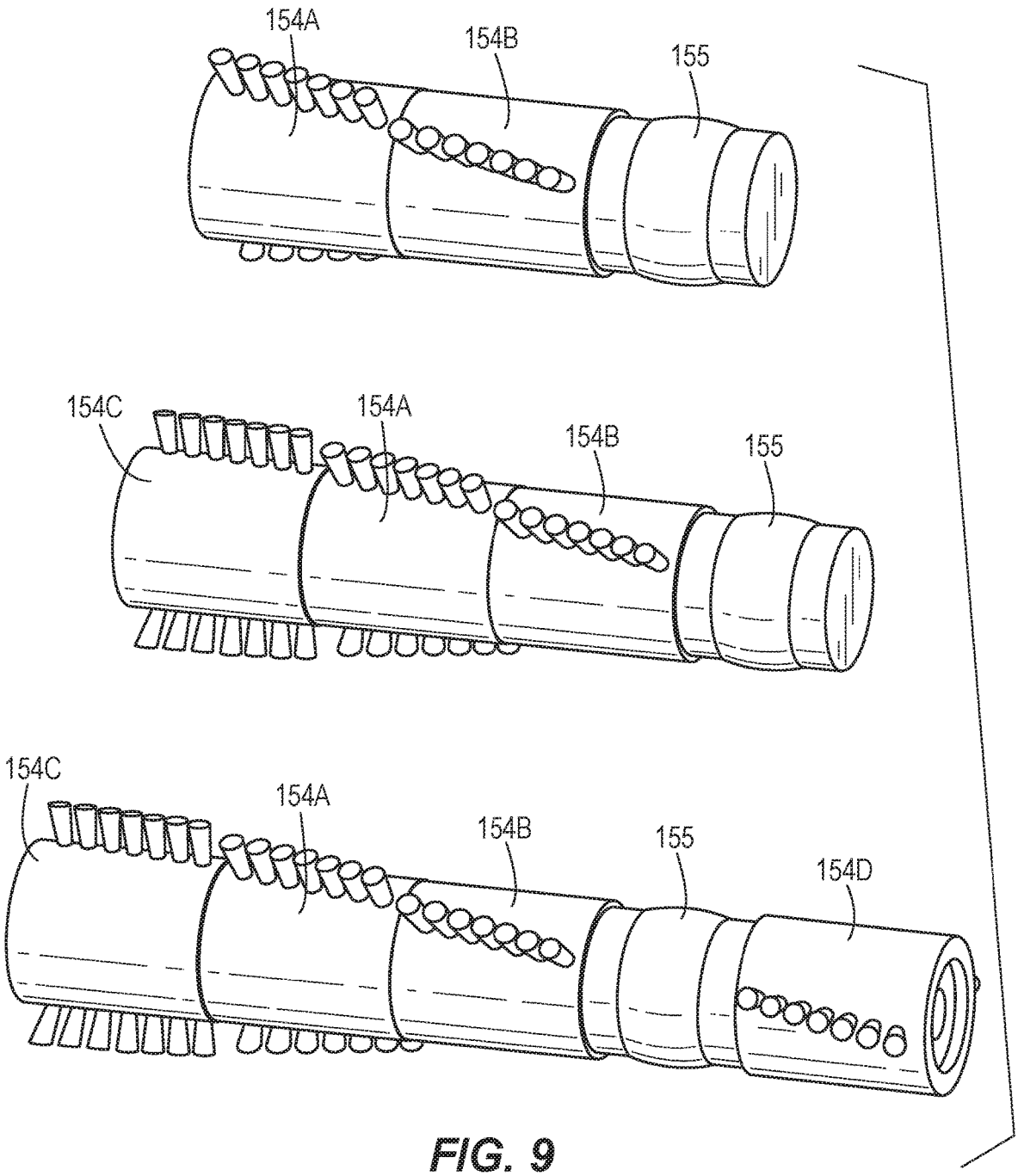
FIG. 9 illustrates perspective views of a brushroll according to another embodiment.

Referring to FIGS. 5 and 8, the brush members 40 extend from the face 26 of the rib 24A along a longitudinal axis 48 of the brush member 40. An angle 42 is defined between the longitudinal axis 48 and the line 28. In one embodiment, the angle 42 is in a range from 70 degrees to 110 degrees. In other embodiment, the angle 42 is in a range from about 80 degrees to 100 degrees. The brush members 40 extend from the face 26*a* length 44 such that a portion 46 of the length 44 of the brush members 40 are drawn along the surface to be cleaned as the brushroll 10 rotates about the axis 20. In one embodiment, the length 44 is greater than 0.5 times the cylindrical portion diameter 36. In one embodiment, the length 44 is greater than 0.65 times the cylindrical portion diameter 36. In yet another embodiment, the length is between 0.7 and 1.5 times the cylindrical portion diameter 36. The configuration of the face 26 and length 44, described above, allows the brush members 40 to be dragged along the surface being cleaned. Also, in the illustrated embodiment, a portion 56 of the brush member 40 adjacent the face 26 is parallel, plus or minus 20 degrees, to the tangent 50 of the cylindrical portion at the contact edge 34, as represented by longitudinal axis 48 in FIG. 5.

Figure 15B:
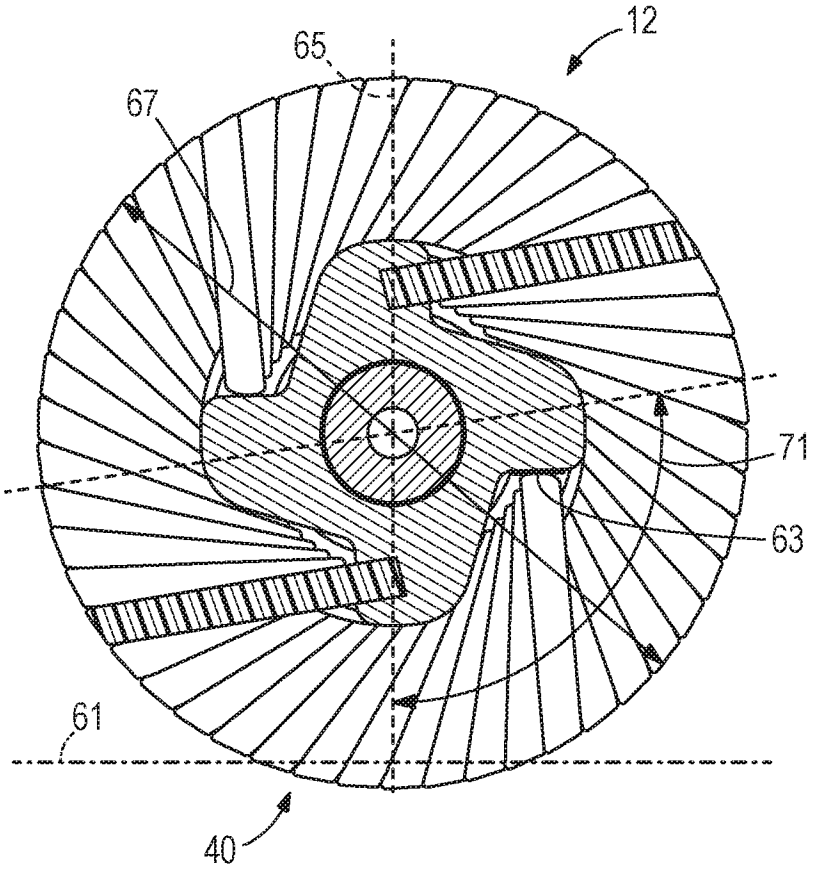
FIG. 15B is a side view of a brushroll of the surface cleaning device of FIG. 1 interacting with a floor.
Figure 15A:
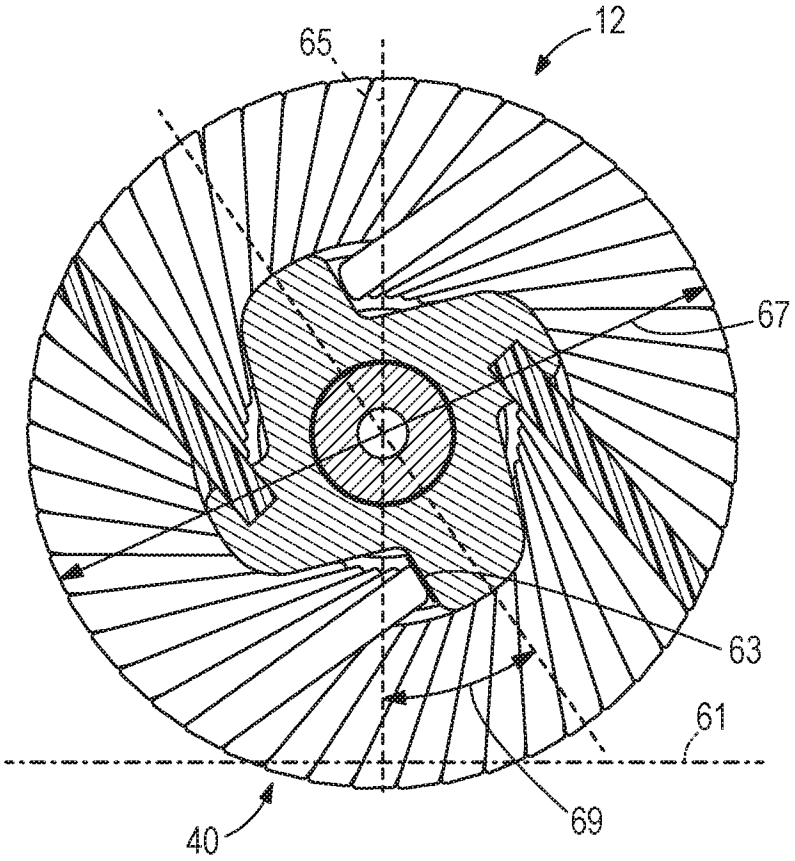
FIG. 15A is a side view of a brushroll of the surface cleaning device of FIG. 1 interacting with a floor.

FIGS. 15A and 15B illustrate the interaction of the brush members 40 with a floor 61. For a given diameter 67 of brushroll 12, an offset rib face 63 provides for a longer filament of the brush members 40, which in turn provides an improved sweeping action. As shown in FIG. 15A, the brush members 40 engage with the floor 61 when the rib face 63 is offset further from a vertical plane 65 than a traditional brushroll. Therefore, the brush members 40 sweep a relatively large distance or angle along the floor 61. For example, as shown in FIG. 15A, initially a brush member 40 first contacts the floor 61 at an angle 69 of rotation of the brushroll 12 that is 40 degrees relative to the vertical plane 65. The same brush member 40 continues to contact the floor 61 until the brushroll 12 rotates to an angle 71 measured from the vertical plane 65 that is 100 degrees in the illustrated embodiment. Therefore, the brush member 40 contacts the floor 61 for about 60 degrees of rotation of the brushroll 12. In other embodiments, the brush member 40 contacts the floor 61 between 40 degrees and 75 degrees of rotation of the brushroll 12. In another embodiment, the brush member 40 contacts the floor 61 between 50 degrees and 65 degrees of rotation of the brushroll 12. In yet another alternative, the brush member 40 contacts the floor 61 for more than 50 degrees of rotation of the brushroll 12.

In the illustrated embodiment, the brush members 40 include polymer bristles. In other embodiments, other suitable type of brush members may be used, such as fiber or rubber bristles, cloth strips or pads, beater bars, wipers, bristle strips, microfiber, and the like.

Figure 6:
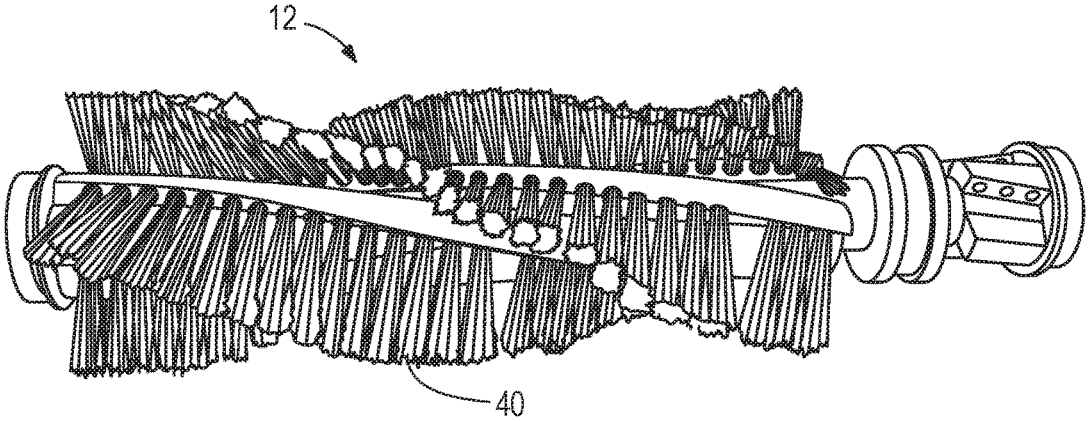
FIG. 6 is a perspective view of another embodiment of a brushroll for use with the surface cleaning apparatus of FIG. 1.
Figure 10:
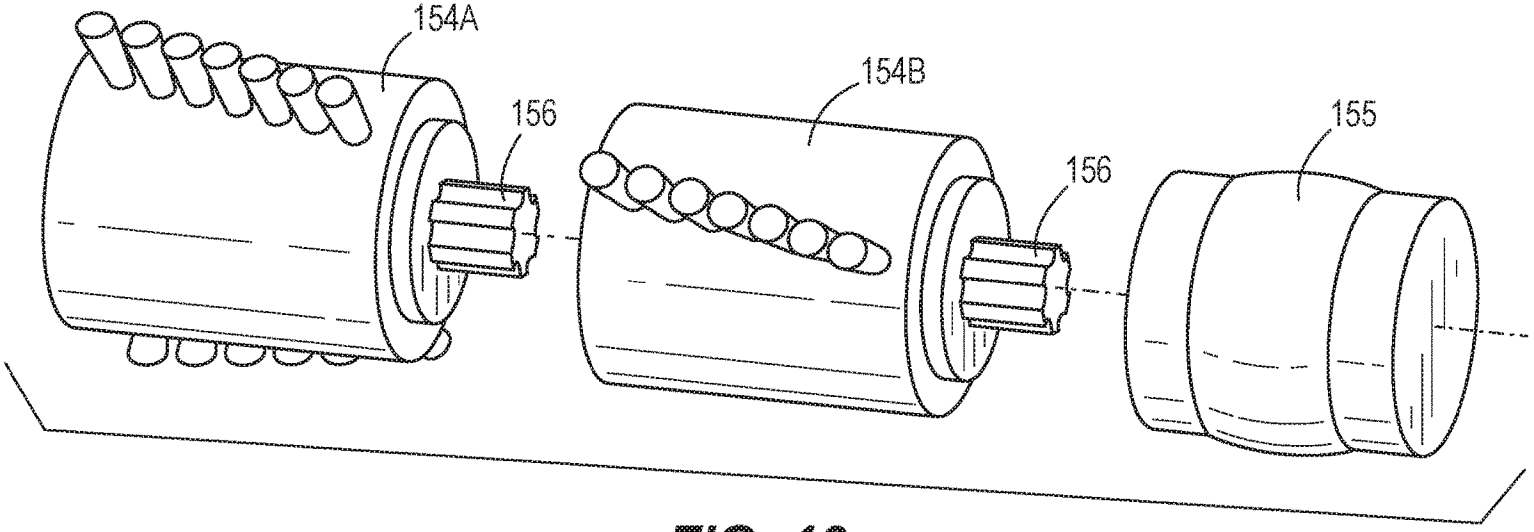
FIG. 10 is an exploded view of the brushroll of FIG. 9.

The brushroll body may be formed as a unitary structure, such as molded, machined, formed, cast, or otherwise formed as a one-piece body, or may be formed from two or more separate segments 54 (FIG. 4) that are attached together to form the brushroll body in a modular assembly. In one embodiment, the brushroll body is formed by two or more modular segments 154A-C assembled in axial alignment such as illustrated in FIG. 10. Whether a unitary or modular brushroll body, the ribs may be formed in segments 54 rotated or indexed slightly with respect to the adjacent segment 54 to create a stepped or segmented helical shape of the ribs 24A-24F as illustrated by the embodiment in FIGS. 3-5. Alternatively, whether unitary or modular, the ribs may form a continuous rib along the brushroll body as illustrated by the embodiment in FIGS. 6-8.

Figure 11:
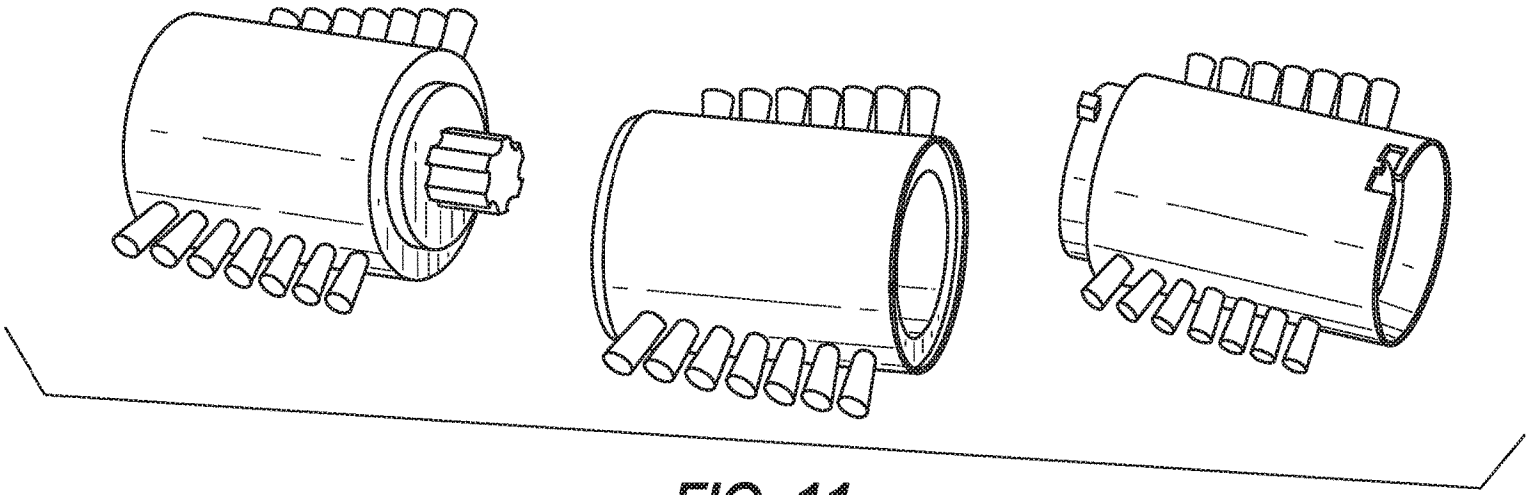
FIG. 11 is an exploded view of a brushroll according to another embodiment.

The brushroll body may be formed as a modular assembly with a plurality of segments 154A-154D such as the embodiment shown in FIGS. 9-14. This modular design allows for any suitable number of segments 154A-154D to be combined. This can provide for many different length brushrolls, color patterns, and pulley 155 locations. In the embodiment shown in FIG. 10, the modular segments 154A-154D include a projection 156 that is received in a corresponding aperture to couple the segments 154A-154D and optional pulley 155 for co-rotation in axial alignment. The projection 156 may be gear-shaped, square, keyed, polygonal, cylindrical, or any other shaped projection. The shape of the projection may be indexable in the corresponding aperture. Stated another way, the shape of the projection may fit into the aperture in two or more orientations to allow the segments 154 to be indexed or rotated a desired amount relative to the adjacent segment. The segments 154A-154D and optional pulley 155 can be fastened together by insert molding, press fitting, welding, gluing, bolts, screws, collar flanges, latches, and the like. The modular segments optionally may include tabs, keys, or other features such as shown in FIG. 11 in addition to the projection 156 that couple with corresponding features on an adjacent segment to provide a keyed or fitted orientation to aid in assembly of the segments in a desired arrangement, and may provide resistance to relative rotation between modular segments.

Figure 12:
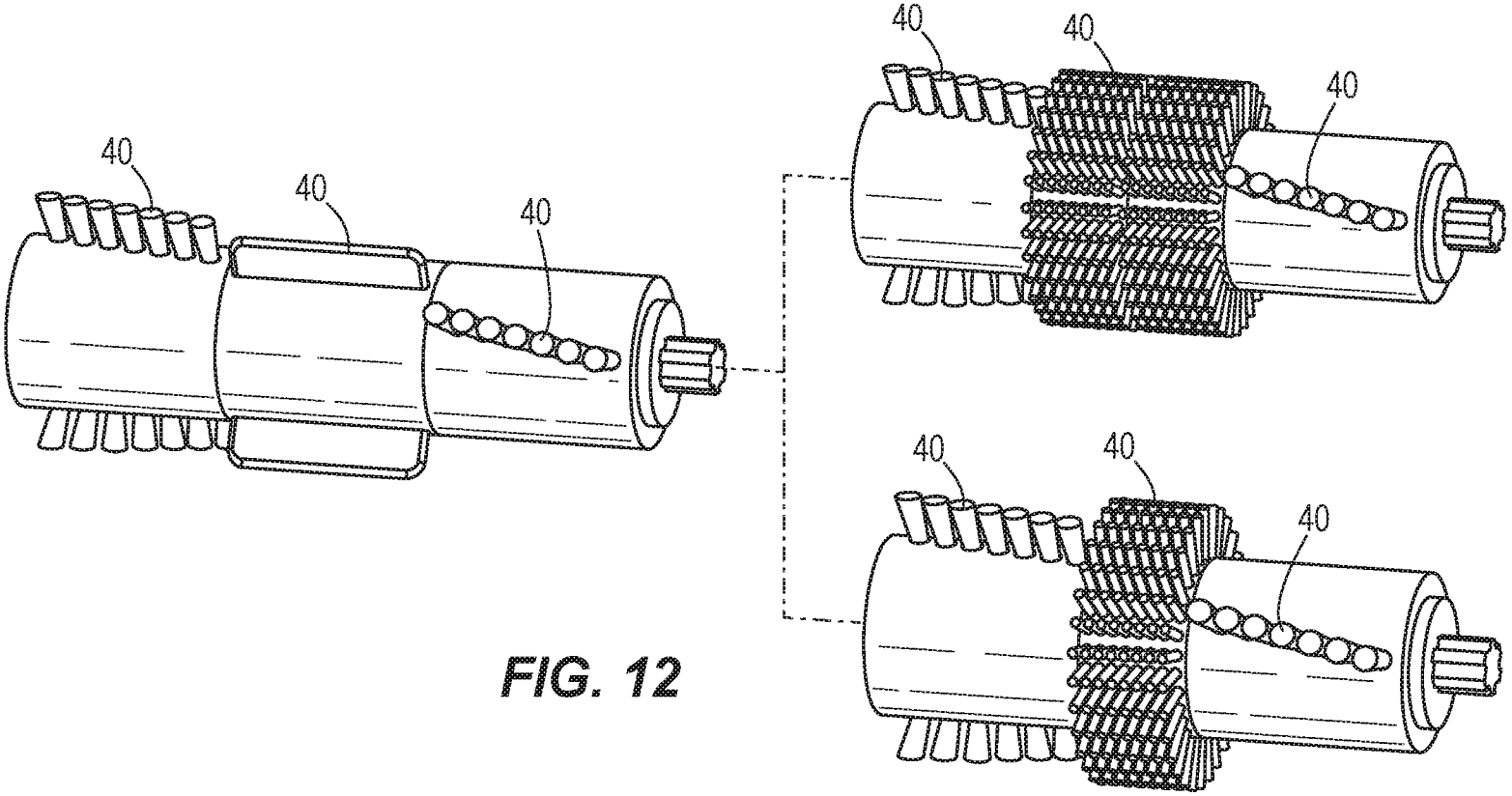
FIG. 12 illustrates perspective views of a brushroll according to another embodiment.
Figure 13:
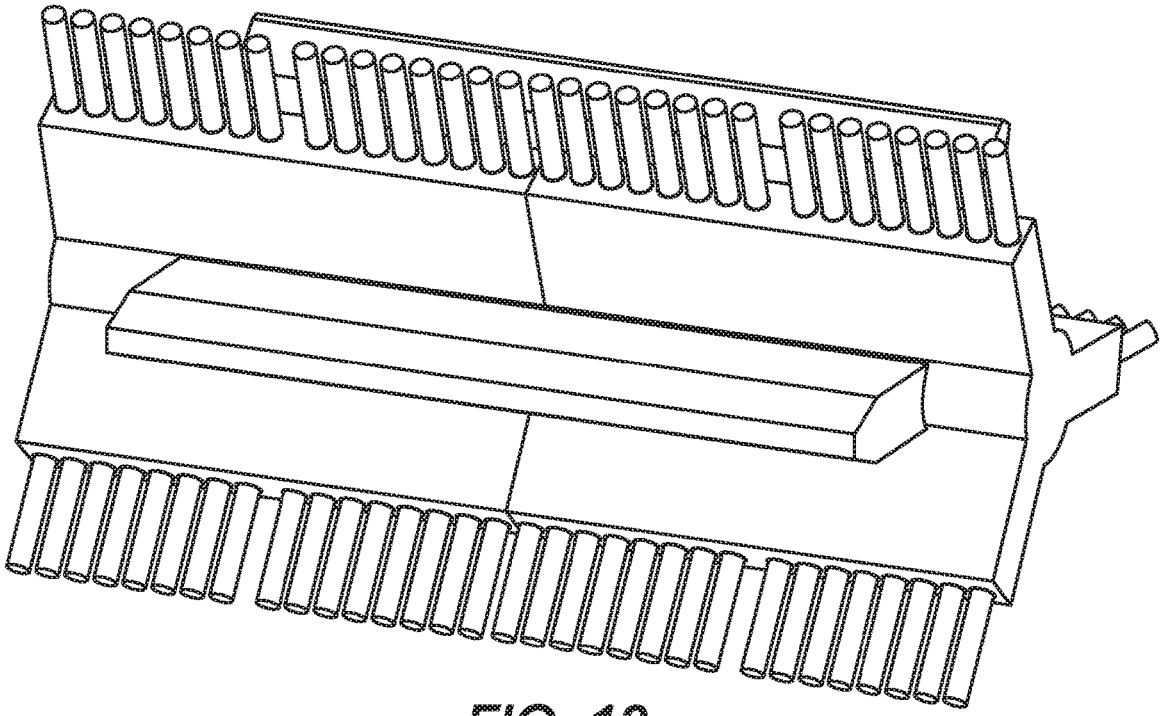
FIG. 13 is a perspective view of a brushroll according to another embodiment.
Figure 14:
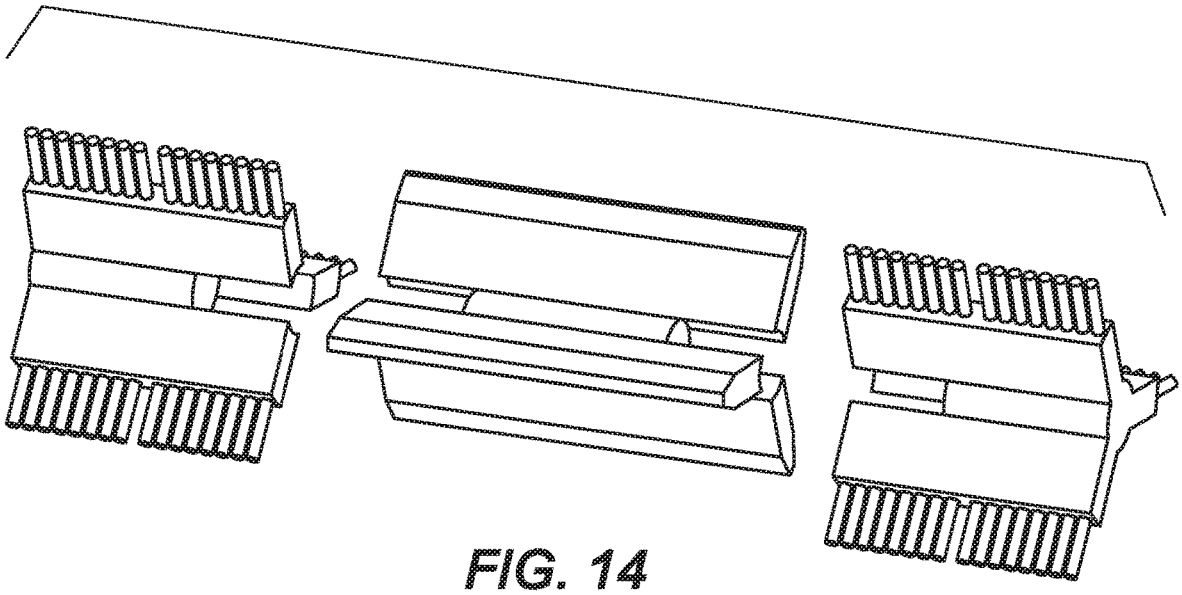
FIG. 14 is an exploded view of the brushroll of FIG. 13.

In one embodiment shown in FIG. 12, one or more of the modular segments include different types and configurations of brush members 40. Alternatively or additionally, brush members such as beater bars, wipers, bristle strips, cloth strips, microfiber, or other brush members may be installed over or between or in the form of segments. In the embodiment shown in FIGS. 13 and 14, a segment includes beater bar members positioned to overlap adjacent segments providing multiple interactions in the same area.

Various features of the invention are set forth in the following claims.

What is claimed is:

1. A surface cleaning apparatus comprising:

a brushroll that rotates about an axis, the brushroll defining a cylindrical portion with a cylindrical portion diameter and the axis extending centrally through the cylindrical portion, the brushroll further including a rib that extends in a direction away from the axis, wherein the rib includes a face extending along a line that is collinear with a secant through the cylindrical portion to an outer diameter, wherein the cylindrical portion diameter is more than 50% of the outer diameter, and wherein a brush member extends from the face.

2. The surface cleaning apparatus of claim 1, wherein the rib extends helically along and around the axis.

3. The cleaning apparatus of claim 1, wherein the brushroll includes a plurality of ribs, wherein each of the ribs extends helically along and around the axis.

4. The cleaning apparatus of claim 3, wherein the brushroll includes at least three ribs.

5. The cleaning apparatus of claim 1, further comprising, a suction source;

a dirt separator in fluid communication with the suction source; and a suction nozzle in fluid communication with the dirt separator and the suction source.

6. The cleaning apparatus of claim 1, wherein the brush member extends from the face a length such that a portion of the length of the brush member is drawn along the surface to be cleaned as the brushroll rotates about the axis.

7. The cleaning apparatus of claim 6, wherein the brush member extends from the face a length that is larger than 0.5 times the cylindrical portion diameter.

8. The cleaning apparatus of claim 6, wherein the brush member extends from the face a length that is larger than 0.65 times the cylindrical portion diameter.

9. The cleaning apparatus of claim 6, wherein the brush member extends from the face a length that is between 0.7 and 1.5 times the cylindrical portion diameter.

10. The cleaning apparatus of claim 1, wherein the brush member includes a plurality of polymer bristles.

11. The cleaning apparatus of claim 1, wherein the brushroll is formed by two or more modular segments assembled in axial alignment.

12. A surface cleaning apparatus comprising:

a brushroll that rotates about an axis, the brushroll including a body, a rib extending outwardly from the body, the rib having a face that forms an angle in the range of 60-120 degrees with respect to the body, and a brush member extending outwardly the face, the brush member forming an angle in the range of 70-110 degrees with respect to the face, the brush member extending a length larger than 0.5 times a diameter of the body.

13. The surface cleaning apparatus of claim 12, wherein the rib extends helically along and around the axis.

14. The cleaning apparatus of claim 12, wherein the brushroll includes a plurality of ribs, wherein each of the ribs extends helically along and around the axis.

15. The cleaning apparatus of claim 14, wherein the brushroll includes at least three ribs.

16. The cleaning apparatus of claim 12, further comprising, a suction source;

a dirt separator in fluid communication with the suction source; and a suction nozzle in fluid communication with the dirt separator and the suction source.

17. The cleaning apparatus of claim 12, wherein the brush member extends from the face a length such that a portion of the length of the brush member is drawn along the surface to be cleaned as the brushroll rotates about the axis.

18. The cleaning apparatus of claim 17, wherein the brush member extends from the face a length that is larger than 0.65 times the diameter of the body.

19. The cleaning apparatus of claim 17, wherein the brush member extends from the face a length that is between 0.7 and 1.5 times the diameter of the body.

20. The cleaning apparatus of claim 12, wherein the brush member includes a plurality of polymer bristles.

21. The cleaning apparatus of claim 12, wherein the brushroll body is formed by two or more modular segments assembled in axial alignment.

* * * * *